US011617435B2

(12) United States Patent
Kagawa et al.

(10) Patent No.: US 11,617,435 B2
(45) Date of Patent: Apr. 4, 2023

(54) EATING-DRINKING ENVIRONMENT CONTROL SYSTEM, EATING-DRINKING ENVIRONMENT INFORMATION PROVIDING SYSTEM, AND EATING-DRINKING ENVIRONMENT CHANGE APPARATUS

(71) Applicant: DAIKIN INDUSTRIES, LTD., Osaka (JP)

(72) Inventors: Sanae Kagawa, Osaka (JP); Masayuki Inoue, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/054,472

(22) PCT Filed: May 10, 2019

(86) PCT No.: PCT/JP2019/018783
§ 371 (c)(1),
(2) Date: Nov. 10, 2020

(87) PCT Pub. No.: WO2019/221030
PCT Pub. Date: Nov. 21, 2019

(65) Prior Publication Data

US 2021/0052068 A1 Feb. 25, 2021

(30) Foreign Application Priority Data

May 18, 2018 (JP) ..... JP2018-096224

(51) Int. Cl.
*F24F 11/00* (2018.01)
*A47B 31/02* (2006.01)
(Continued)

(52) U.S. Cl.
CPC ..... *A47B 31/02* (2013.01); *F24F 11/64* (2018.01); *F24F 11/79* (2018.01); *F24F 2110/10* (2018.01); *F24F 2110/20* (2018.01)

(58) Field of Classification Search
CPC ..... A47B 31/02; F24F 11/64; F24F 11/79
See application file for complete search history.

(56) References Cited

U.S. PATENT DOCUMENTS 4,038,518 A * 7/1977 Morton ..... H05B 6/1209 219/218
9,976,750 B1 * 5/2018 Kestner ..... A47J 36/2483
(Continued)

FOREIGN PATENT DOCUMENTS

CN 106963123 A 7/2017
CN 107560090 A 1/2018
(Continued)

OTHER PUBLICATIONS

International Preliminary Report of corresponding PCT Application No. PCT/JP2019/018783 dated Dec. 3, 2020.
(Continued)

*Primary Examiner* — Mark A Connolly
(74) *Attorney, Agent, or Firm* — Global IP Counselors, LLP

(57) ABSTRACT

An eating-drinking environment control system includes a food surrounding environment information storage unit and an environment control unit. The food surrounding environment information storage unit stores, for each of a plurality of food products, food surrounding environment information including at least one of a temperature and a humidity in association with the food product. The environment control unit controls an eating-drinking environment based on the food surrounding environment information.

20 Claims, 11 Drawing Sheets

| FOOD PRODUCT ID | FOOD PRODUCT NAME | TEMPERATURE | HUMIDITY | BEST-BEFORE TIME |
|---|---|---|---|---|
| S001 | HOT FOOD1 | TEMPERATURE T1 | HUMIDITY H1 | BEST-BEFORE D1 |
| S002 | HOT FOOD2 | TEMPERATURE T2 | HUMIDITY H2 | BEST-BEFORE D2 |
| S003 | COLD FOOD1 | TEMPERATURE T3 | HUMIDITY H3 | BEST-BEFORE D3 |
| S004 | COLD FOOD2 | TEMPERATURE T4 | HUMIDITY H4 | BEST-BEFORE D4 |
| S005 | HOT DRINK | TEMPERATURE T5 | HUMIDITY H5 | BEST-BEFORE D5 |

(51) Int. Cl.

| | |
|---|---|
| ***F24F 11/64*** | (2018.01) |
| *F24F 110/20* | (2018.01) |
| *F24F 110/10* | (2018.01) |
| *F24F 11/79* | (2018.01) |

(56) References Cited

U.S. PATENT DOCUMENTS

| | | | | |
|---|---|---|---|---|
| 11,338,107 | B2 * | 5/2022 | Allen | G05B 15/02 |
| 2002/0082924 | A1 * | 6/2002 | Koether | G06Q 10/087 705/15 |
| 2017/0046801 | A1 * | 2/2017 | Byron | G06Q 50/12 |
| 2019/0268999 | A1 * | 8/2019 | Oobayashi | F24F 11/74 |

FOREIGN PATENT DOCUMENTS

| | | | |
|---|---|---|---|
| JP | 2003-120983 | A | 4/2003 |
| JP | 2005-300075 | A | 10/2005 |
| JP | 2005-344952 | A | 12/2005 |
| JP | 5857009 | B2 | 12/2015 |
| TW | M546739 | U | 8/2017 |

OTHER PUBLICATIONS

International Search Report of corresponding PCT Application No. PCT/JP2019/018783 dated Jul. 2, 2019.

European Search Report of corresponding EP Application No. 19 804 374.7 dated Feb. 4, 2022.

Guizhou Wine Encyclopedia Editiorial Board; "Guizhou Wine Encyclopedia"; Jun. 2016, p. 274-275; Guizhou People's Publishing House; Guizhou, China.

* cited by examiner

| FOOD PRODUCT ID | FOOD PRODUCT NAME | TEMPERATURE | HUMIDITY | BEST-BEFORE TIME |
|---|---|---|---|---|
| S001 | HOT FOOD1 | TEMPERATURE T1 | HUMIDITY H1 | BEST-BEFORE D1 |
| S002 | HOT FOOD2 | TEMPERATURE T2 | HUMIDITY H2 | BEST-BEFORE D2 |
| S003 | COLD FOOD1 | TEMPERATURE T3 | HUMIDITY H3 | BEST-BEFORE D3 |
| S004 | COLD FOOD2 | TEMPERATURE T4 | HUMIDITY H4 | BEST-BEFORE D4 |
| S005 | HOT DRINK | TEMPERATURE T5 | HUMIDITY H5 | BEST-BEFORE D5 |

EATING-DRINKING ENVIRONMENT CONTROL SYSTEM, EATING-DRINKING ENVIRONMENT INFORMATION PROVIDING SYSTEM, AND EATING-DRINKING ENVIRONMENT CHANGE APPARATUS

CROSS-REFERENCE TO RELATED APPLICATIONS

This U.S. National stage application claims priority under 35 U.S.C. § 119(a) to Japanese Patent Application No. 2018-096224, filed in Japan on May 18, 2018, the entire contents of which are hereby incorporated herein by reference.

BACKGROUND

Field of the Invention

The present disclosure relates to an eating-drinking environment control system, an eating-drinking environment information providing system, and an eating-drinking environment change apparatus.

Background Information

Currently, a technique related to temperature control in an eating-drinking environment is being investigated. For example, Japanese Patent No. 5857009 discloses a technique for avoiding, for example, heat or a chill resulting from eating or drinking by controlling, in accordance with the details of an order accepted by a handset, air conditioning of a place where the handset is present.

SUMMARY

However, the above-described technique disclosed in Japanese Patent No. 5857009 does not take into consideration a specific temperature at which food tastes good, and a meal might not be served tastily over a long duration of the meal.

An eating-drinking environment control system according to a first aspect includes a food surrounding environment information storage unit and an environment control unit. The food surrounding environment information storage unit stores, for each food product, food surrounding environment information including at least a temperature and/or a humidity in association with the food product. The environment control unit controls an eating-drinking environment on the basis of the food surrounding environment information. With this configuration, the eating-drinking environment is controlled on the basis of the food surrounding environment information associated with each food product, and therefore, satisfaction with the meal can be increased.

Note that in the present disclosure, "food product" means anything to eat or drink.

An eating-drinking environment control system according to a second aspect is the eating-drinking environment control system according to the first aspect, in which the environment control unit includes an air conditioner. With this configuration, the conditioned air in the eating-drinking environment can be controlled on the basis of the food surrounding environment information associated with each food product.

An eating-drinking environment control system according to a third aspect is the eating-drinking environment control system according to the second aspect, in which the air conditioner includes a position detection unit that detects a position of the food product and/or a position of a user having a meal. The air conditioner controls a direction of airflow and a volume of airflow on the basis of the position of the food product and/or the position of the user. With this configuration, the direction of airflow and the volume of airflow of the conditioned air in the eating-drinking environment can be controlled in accordance with the position of the food product and/or the position of the user.

An eating-drinking environment control system according to a fourth aspect is the eating-drinking environment control system according to the first to third aspects, in which the environment control unit includes a meal serving table that has a surface part for which temperature regulation is possible. With this configuration, the ambient temperature of the food product can be optimized by using the meal serving table.

An eating-drinking environment control system according to a fifth aspect is the eating-drinking environment control system according to the fourth aspect, in which for the surface part, temperature distribution regulation is possible. With this configuration, the temperature can be made different depending on the position on the surface part.

An eating-drinking environment control system according to a sixth aspect is the eating-drinking environment control system according to the first to fifth aspects, in which the food surrounding environment information storage unit further stores, for each food product, a best-before time of the food product corresponding to a predetermined food surrounding environment. The environment control unit controls the eating-drinking environment on the basis of the best-before time of a certain food product. With this configuration, the eating-drinking environment can be regulated so as to match the best-before time of the certain food product.

An eating-drinking environment control system according to a seventh aspect is the eating-drinking environment control system according to the first to sixth aspects, further including a served-food information obtaining unit that obtains information about a food product that is served in the eating-drinking environment. The environment control unit controls the eating-drinking environment on the basis of the information about the food product obtained by the served-food information obtaining unit. With this configuration, the eating-drinking environment can be controlled in accordance with the served food product.

An eating-drinking environment control system according to an eighth aspect is the eating-drinking environment control system according to the seventh aspect, in which the served-food information obtaining unit includes an image data obtaining unit that obtains an image of a food product served to a user having a meal. With this configuration, the eating-drinking environment can be controlled on the basis of the image of the served food product.

An eating-drinking environment control system according to a ninth aspect is the eating-drinking environment control system according to the seventh or eighth aspect, in which the served-food information obtaining unit includes a food accepting unit that accepts input of information indicating a certain food product. With this configuration, the eating-drinking environment can be controlled on the basis of the served food product.

An eating-drinking environment control system according to a tenth aspect is the eating-drinking environment control system according to any of the first to ninth aspects, further including a sequence information obtaining unit that obtains information about a sequence in which a plurality of food products are to be served, or a sequence information storage unit that stores in advance information about a sequence in which a plurality of food products are to be served. The environment control unit controls the eating-drinking environment on the basis of the sequence in which the food products are to be served and the food surrounding environment information. With this configuration, the eating-drinking environment can be regulated so as to be suitable to the combination of the plurality of food products.

An eating-drinking environment control system according to an eleventh aspect is the eating-drinking environment control system according to any of the first to tenth aspects, in which the environment control unit further includes a setting change unit that accepts a change in a setting for controlling the eating-drinking environment. With this configuration, the eating-drinking environment that reflects the intention of the system user can be provided.

An eating-drinking environment information providing system according to a twelfth aspect includes a food surrounding environment information storage unit and a food surrounding environment information providing unit. The food surrounding environment information storage unit stores, for each food product, food surrounding environment information including at least a temperature and/or a humidity in association with the food product. The food surrounding environment information providing unit outputs a food surrounding environment desired value corresponding to at least a temperature and/or a humidity on the basis of the food surrounding environment information. With this configuration, a food surrounding environment desired value with which satisfaction with the meal can be increased can be output to, for example, an external apparatus.

An eating-drinking environment information providing system according to a thirteenth aspect is the eating-drinking environment information providing system according to the twelfth aspect, further including a sequence information obtaining unit that obtains information about a sequence in which a plurality of food products are to be served, or a sequence information storage unit that stores in advance information about a sequence in which a plurality of food products are to be served. The food surrounding environment information providing unit outputs the food surrounding environment desired value on the basis of the sequence in which the food products are to be served and the food surrounding environment information. With this configuration, a food surrounding environment desired value suitable to the combination of the plurality of food products can be output.

An eating-drinking environment information providing system according to a fourteenth aspect is the eating-drinking environment information providing system according to the twelfth or thirteenth aspect, in which the food surrounding environment information storage unit further stores, for each food product, a best-before time of the food product corresponding to a predetermined food surrounding environment. The food surrounding environment information providing unit outputs the food surrounding environment desired value on the basis of the best-before time of a certain food product. With this configuration, a food surrounding environment desired value that matches the best-before time of the certain food product can be output.

An eating-drinking environment information providing system according to a fifteenth aspect is the eating-drinking environment information providing system according to any of the twelfth to fourteenth aspects, further including a served-food information obtaining unit that obtains information about a food product that is served in an eating-drinking environment. The food surrounding environment information providing unit outputs the food surrounding environment desired value further on the basis of the information about the food product obtained by the served-food information obtaining unit. With this configuration, a food surrounding environment desired value suitable to the food product served in the eating-drinking environment can be output.

An eating-drinking environment information providing system according to a sixteenth aspect is the eating-drinking environment information providing system according to the fifteenth aspect, in which the served-food information obtaining unit includes an image data obtaining unit that obtains an image of a food product served to a user having a meal. With this configuration, the food surrounding environment desired value can be output on the basis of the image of the food product served in the eating-drinking environment.

An eating-drinking environment information providing system according to a seventeenth aspect is the eating-drinking environment information providing system according to the fifteenth or sixteenth aspect, in which the served-food information obtaining unit includes a food accepting unit that accepts input of information indicating a certain food product. With this configuration, a food surrounding environment desired value suitable to the food product served in the eating-drinking environment can be output.

An eating-drinking environment change apparatus according to an eighteenth aspect includes a desired-value obtaining unit and an environment change unit. The desired-value obtaining unit obtains a food surrounding environment desired value output from the food surrounding environment information providing unit of the eating-drinking environment information providing system according to any of the twelfth to seventeenth aspects. The environment change unit changes an eating-drinking environment on the basis of the food surrounding environment desired value. With this configuration, the eating-drinking environment can be controlled on the basis of the food surrounding environment desired value associated with each food product.

An eating-drinking environment change apparatus according to a nineteenth aspect is the eating-drinking environment change apparatus according to the eighteenth aspect, further including a position detection unit that detects a position of a food product and/or a position of a user having a meal. The food surrounding environment information providing unit outputs the food surrounding environment desired value corresponding to at least a temperature and/or a humidity on the basis of the position of the food product and/or the position of the user having a meal. With this configuration, the eating-drinking environment can be changed in accordance with the position of the food product and/or the position of the user.

An eating-drinking environment change apparatus according to a twentieth aspect is the eating-drinking environment change apparatus according to the eighteenth or nineteenth aspect, further including a setting change unit that accepts a change in a setting for controlling the eating-drinking environment. With this configuration, the eating-drinking environment can be changed so as to reflect the intention of the system user.

DETAILED DESCRIPTION OF EMBODIMENT(S)

First Embodiment (1-1)

Figure 1:
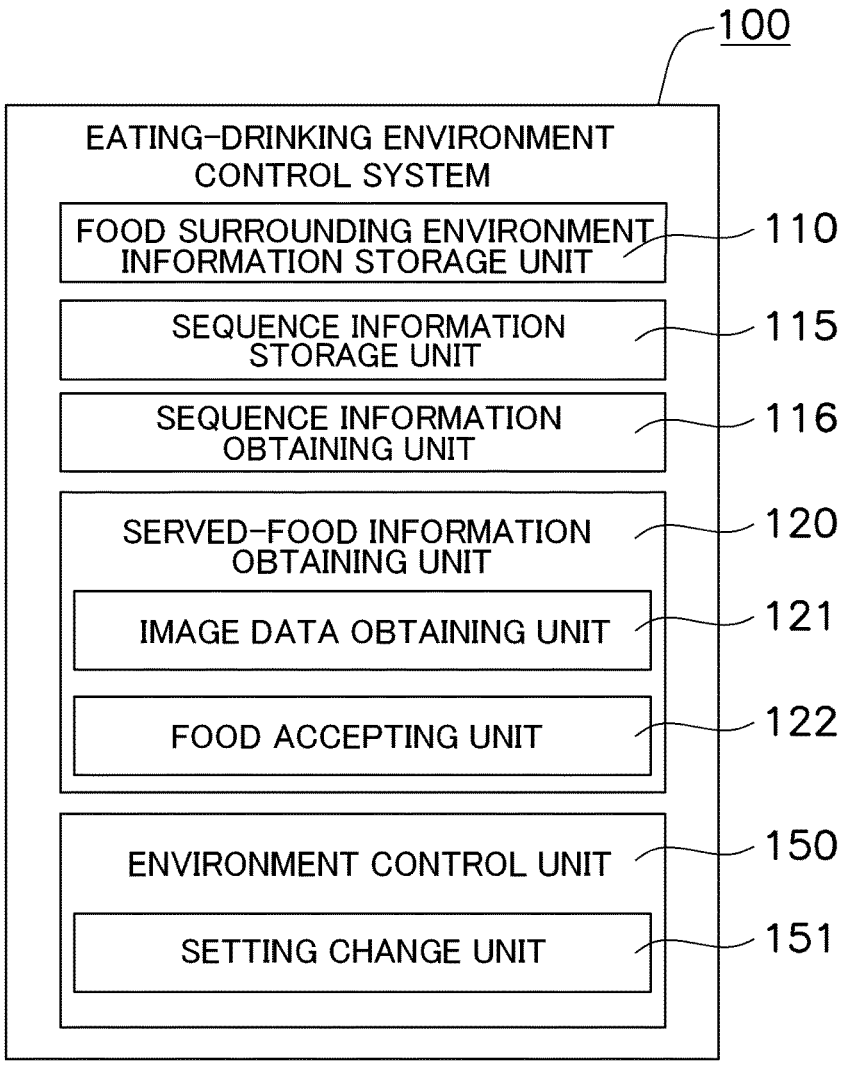
FIG. 1 is a schematic diagram for describing a configuration of an eating-drinking environment control system 100 according to a first embodiment.

FIG. 1 is a schematic diagram for describing a configuration of an eating-drinking environment control system 100 according to a first embodiment.

The eating-drinking environment control system 100 includes at least a food surrounding environment information storage unit 110 and an environment control unit 150. Here, the eating-drinking environment control system 100 further includes a served-food information obtaining unit 120 and a sequence information storage unit 115 and/or a sequence information obtaining unit 116. Note that the eating-drinking environment control system 100 performs information processing by any electronic control device functioning as a processing unit. The eating-drinking environment control system 100 includes any storage device that stores various types of information.

The food surrounding environment information storage unit 110 stores, for each food product, food surrounding environment information including at least a temperature and/or a humidity in association with the food product. "Food surrounding environment information" is defined by the optimum values of respective items, such as the temperature, the humidity, the volume of airflow, and the direction of airflow in the surrounding environment, that affect the food product. However, food surrounding environment information is not limited to this and may be defined by, for example, the temperature and/or humidity of the food product itself. Food surrounding environment information is associated with a food product; however, different values may be used depending on not only the food product but also the condition of the person, or different values may be used depending on the individual. For example, for a person who has had a run, values different from those for a person who has not had a run can be employed. Note that food surrounding environment information can be updated by an input operation by a system user or can be automatically updated on the basis of external data, such as customer satisfaction.

The food surrounding environment information storage unit 110 stores, for each food product, the best-before time of the food product corresponding to a predetermined food surrounding environment. Note that "each food product" mentioned here is a food category that can be set by the system user as desired and, for example, hot noodles and cold noodles can be separately categorized and set although the noodles are the same food products. Further, "best-before time" is not related to food safety but is the time before which the food product tastes good. For example, the best-before time of wine is determined with reference to the degree of taste deterioration in one hour when the temperature of the eating-drinking environment is 16° C. Therefore, for typical wine, the best-before time is shorter than one hour when the temperature of the eating-drinking environment is 20° C. Note that this is only an example, and the reference for the best-before time can be set by the system user as desired.

The sequence information storage unit 115 stores in advance information about the sequence in which a plurality of food products are to be served.

The sequence information obtaining unit 116 obtains information about the sequence in which a plurality of food products are to be served. Here, the sequence information obtaining unit 116 sends the obtained information about the sequence of the food products to the environment control unit 150.

The served-food information obtaining unit 120 obtains via any input device, information about a food product that is served in the eating-drinking environment. The served-food information obtaining unit 120 sends the obtained information about the food product to the environment control unit 150. Specifically, the served-food information obtaining unit 120 can be implemented as an image data obtaining unit 121 that obtains an image of a food product served to a user having a meal. The served-food information obtaining unit 120 can also be implemented as a food accepting unit 122 that accepts input of information indicating a certain food product. Note that the food accepting unit 122 may accept information about a food product via an information terminal that can perform communication by wire or wirelessly. Further, the food accepting unit 122 may accept information about a food product input by voice. In addition, the food accepting unit 122 may accept information about a food product via, for example, a tablet or a smart device that accepts an ordered menu or a remote controller of an air conditioner or may obtain information about a food product by reading an identifier (for example, a bar code) attached to the food container.

The environment control unit 150 controls the eating-drinking environment on the basis of food surrounding environment information. Specifically, the environment control unit 150 uses information about a food product obtained by the served-food information obtaining unit 120 to extract food surrounding environment information from the food surrounding environment information storage unit 110 and controls the eating-drinking environment on the basis of the extracted food surrounding environment information. The environment control unit 150 has a function of controlling the eating-drinking environment on the basis of the best-before time of the certain food product. The environment control unit 150 has a function of controlling the eating-drinking environment on the basis of the sequence in which food products are to be served and food surrounding environment information. Further, the environment control unit 150 includes a setting change unit 151 that accepts a change in a setting for controlling the eating-drinking environment.

Figure 2:
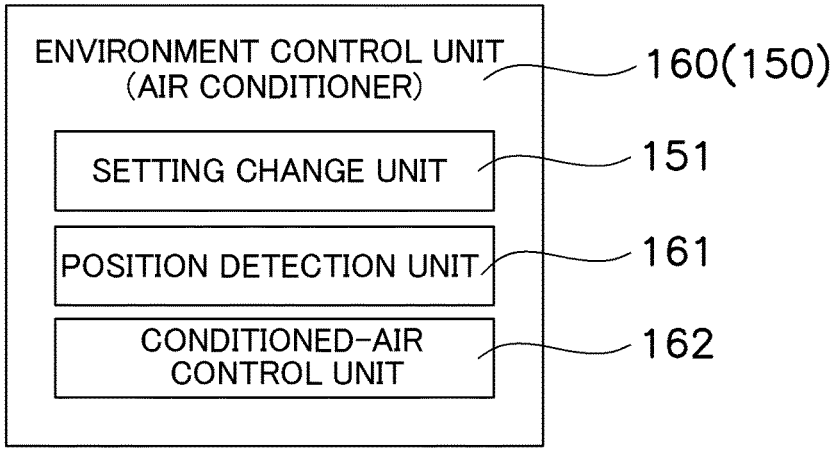
FIG. 2 is a schematic diagram for describing a configuration of an air conditioner 160 according to the first embodiment.

The environment control unit 150 thus configured can be implemented as, for example, an air conditioner 160. The air conditioner 160 that functions as the environment control unit 150 further includes a position detection unit 161 and a conditioned-air control unit 162 as illustrated in FIG. 2. The position detection unit 161 detects the position of a food product and/or the position of a user having a meal. The conditioned-air control unit 162 controls, for example, the temperature, the humidity, the volume of airflow, and the direction of airflow of the conditioned air. Here, the conditioned-air control unit 162 controls, for example, the direction of airflow and the volume of airflow on the basis of the position of a food product and/or the position of a user having a meal detected by the position detection unit 161. Note that the position detection unit 161 may detect the position of a food product not by detecting the food product itself but by detecting the container of the food product. In a case where the position at which a food product is put is stored in advance in the storage device, the position detection unit 161 may obtain the position of the food product from the information stored in the storage device. Note that the position detection unit 161 and the image data obtaining unit 121 can use the same image capturing device.

Figure 3:
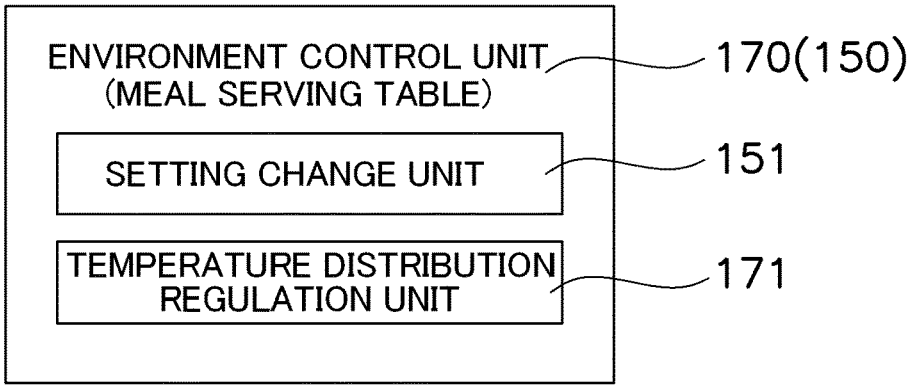
FIG. 3 is a schematic diagram for describing a configuration of a meal serving table 170 according to the first embodiment.

Further, the environment control unit 150 can be implemented as a meal serving table 170. The meal serving table 170 that constitutes the environment control unit 150 includes a temperature distribution regulation unit 171 as illustrated in FIG. 3 and has a surface part for which the temperature distribution can be regulated. For example, the temperature distribution regulation unit 171 is formed by using a Peltier device.

(1-2)

As described above, the eating-drinking environment control system 100 according to the first embodiment includes the food surrounding environment information storage unit 110 and the environment control unit 150 and controls the eating-drinking environment on the basis of food surrounding environment information associated with each food product, and therefore, satisfaction with the meal can be increased.

Further, the eating-drinking environment control system 100 includes the air conditioner 160 as the environment control unit 150, and therefore, the conditioned air in the eating-drinking environment can be controlled on the basis of food surrounding environment information associated with each food product. The air conditioner 160 includes the position detection unit 161, and therefore, the direction of airflow and the volume of airflow of the conditioned air in the eating-drinking environment can be controlled in accordance with the position of the food product and/or the position of the user having a meal. Specifically, the air conditioner 160 can send conditioned air so as to pass around the food product or can send conditioned air so as to pass around the user having a meal. Instead, the air conditioner 160 can send conditioned air toward the food product or can send conditioned air toward the user having a meal.

In a case where the eating-drinking environment control system 100 includes, as the environment control unit 150, the meal serving table 170 that can regulate the temperature distribution of the surface part, the ambient temperature of the food product can be precisely regulated in accordance with the position on the surface part. For example, the meal serving table 170 controls the temperature of the surface part on which a utensil is put to thereby regulate the ambient temperature of the food product.

In the eating-drinking environment control system 100, the food surrounding environment information storage unit 110 stores, for each food product, the best-before time of the food product corresponding to a predetermined food surrounding environment, and therefore, the eating-drinking environment can be controlled in accordance with the best-before time of the certain food product. In other words, the eating-drinking environment can be regulated so as to achieve, for example, an optimum temperature in accordance with the change rate of the quality of the food product (best-before time). For example, in a situation where a wine for which the best-before time is one hour in an eating-drinking environment in which the temperature is 15° C. is served, when the temperature is changed to 10° C. after the elapse of 30 minutes since the serving of the wine, the best-before time of the wine can be regulated so as to be extended to, for example, two hours.

Further, the eating-drinking environment control system 100 includes the served-food information obtaining unit 120 that obtains information about a food product that is served in the eating-drinking environment, and therefore, the eating-drinking environment can be controlled in accordance with the food product that is served in the eating-drinking environment. Specifically, in a case where the served-food information obtaining unit 120 includes the image data obtaining unit 121, the eating-drinking environment can be controlled on the basis of an image of the food product that is served in the eating-drinking environment. Further, in a case where the served-food information obtaining unit 120 includes the food accepting unit 122 that accepts input of information indicating a certain food product, the eating-drinking environment can be controlled in accordance with the accepted information about the food product.

Further, the eating-drinking environment control system 100 includes the sequence information storage unit 115 and/or the sequence information obtaining unit 116, and therefore, the eating-drinking environment can be controlled in accordance with the sequence in which food products are to be served and food surrounding environment information. Accordingly, the eating-drinking environment that is suitable to the combination of the plurality of food products can be achieved. Specifically, in a case where, for example, a course is served, the eating-drinking environment can be regulated in accordance with the progress in the meal. For example, in a situation where a Hamburg steak is served after a salad, for example, the temperature of the eating-drinking environment can be regulated so as to extend the best-before time of the Hamburg steak and to keep the Hamburg steak tasty.

Further, in the eating-drinking environment control system 100, the environment control unit 150 includes the setting change unit 151 that accepts a change in a setting for controlling the eating-drinking environment, and therefore, the eating-drinking environment that reflects the intention of the system user can be provided. For example, even in a case where a food product (for example, a wine) that is colder than the room temperature is served and cold air is sent from the air conditioner 160 in order to maintain the quality of the food product, for example, the user having the meal can change a setting of the air conditioner 160 via the setting change unit 151, and therefore, the possibility of the user having a complaint about an excessive chill can be reduced. In other words, when the setting change unit 151 is provided, a measure against, for example, an excessive chill can be implemented, and the possibility of the user's comfort being compromised can be reduced.

Note that the eating-drinking environment control system 100 may be configured to detect the temperature of a food product and feed the temperature back to the environment control unit 150. With this configuration, the environment control unit 150 can regulate the eating-drinking environment so as to achieve an optimum state on the basis of the detected temperature of the food product and food surrounding environment information.

Second Embodiment (2-1)

Figure 4:
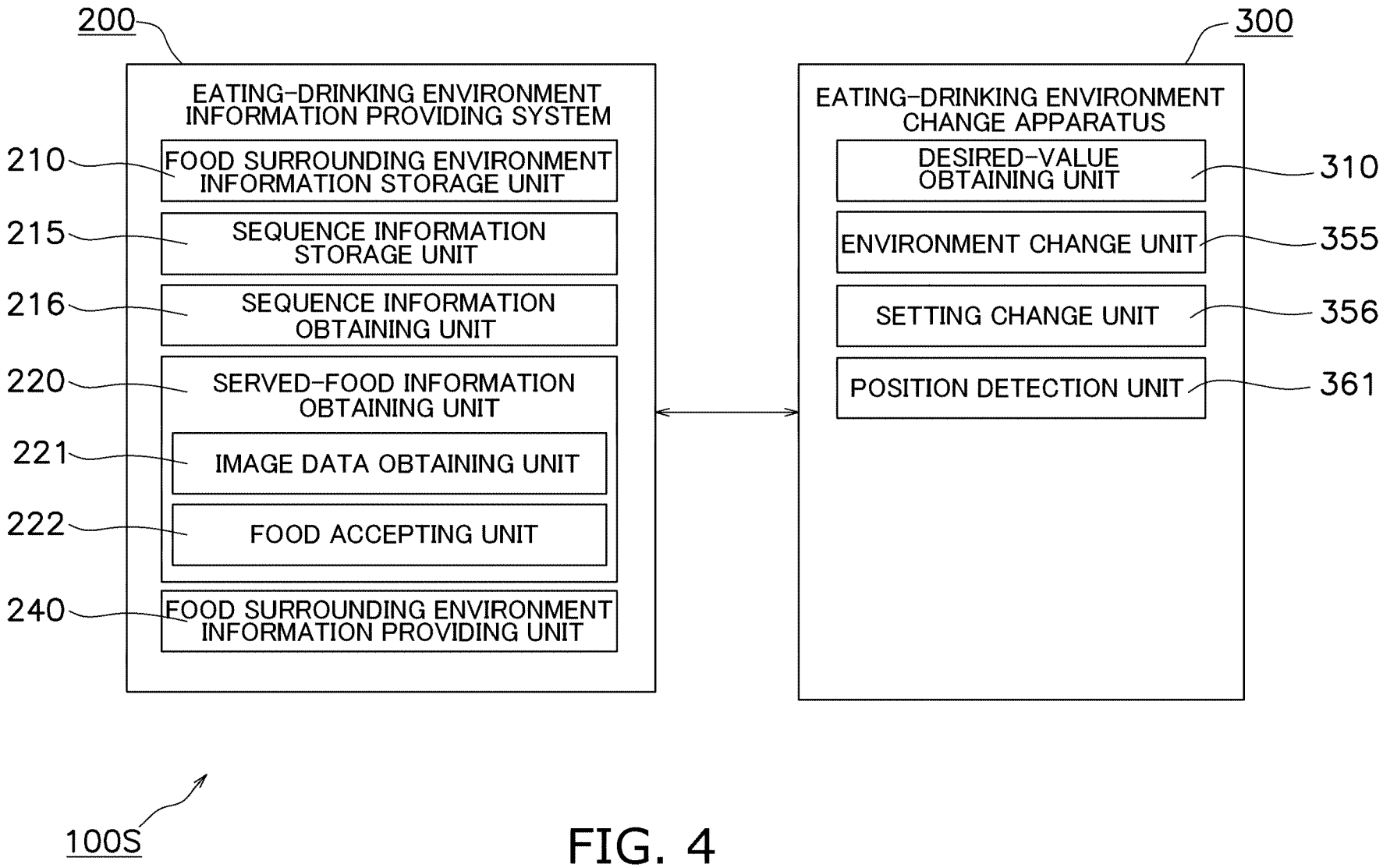
FIG. 4 is a schematic diagram for describing a configuration of an eating-drinking environment control system 100S according to a second embodiment.

FIG. 4 is a schematic diagram for describing a configuration of an eating-drinking environment control system 100S according to a second embodiment. The eating-drinking environment control system 100S according to the second embodiment includes an eating-drinking environment information providing system 200 and an eating-drinking environment change apparatus 300.

Figure 5:
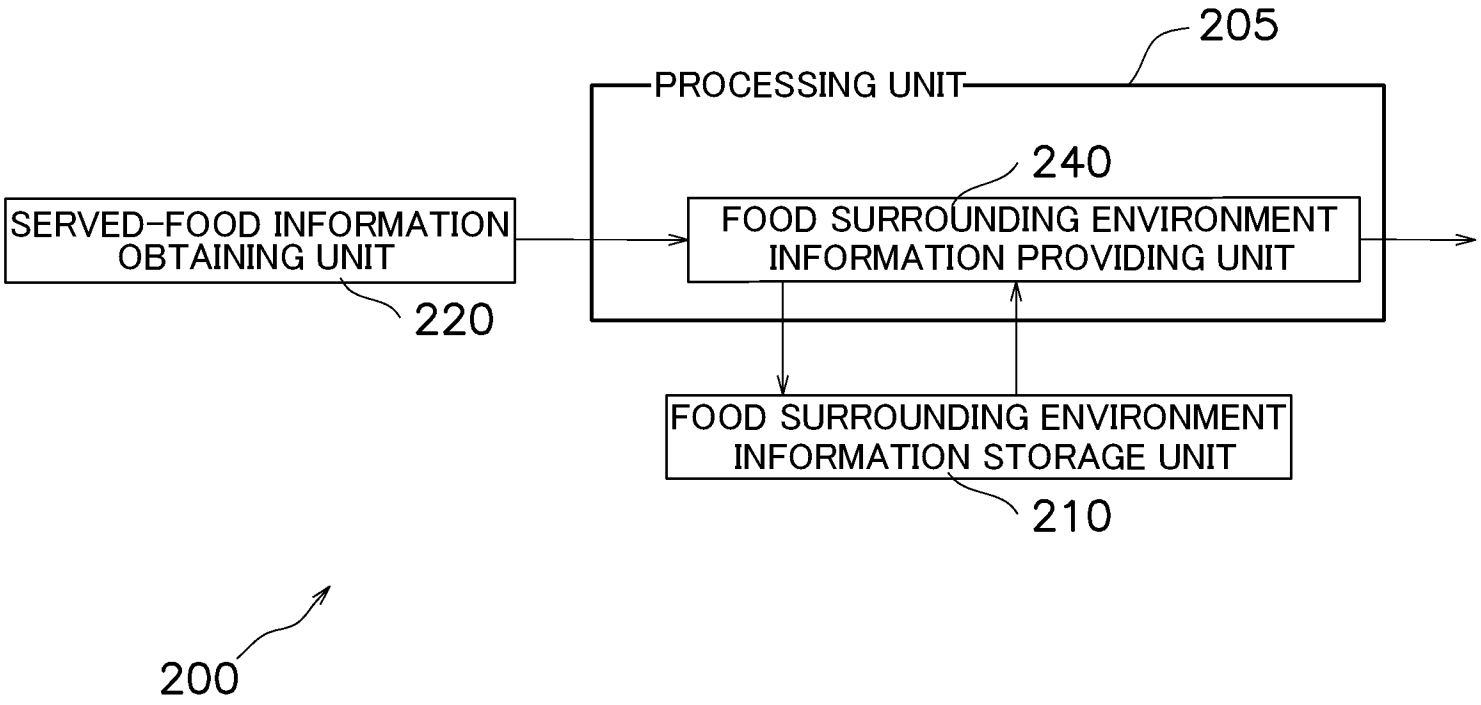
FIG. 5 is a schematic diagram for describing a configuration of an eating-drinking environment information providing system 200 according to the second embodiment.

As illustrated in FIG. 5, the eating-drinking environment information providing system 200 includes at least a food surrounding environment information storage unit 210 and a food surrounding environment information providing unit 240. Here, the eating-drinking environment information providing system 200 further includes a served-food information obtaining unit 220 and a sequence information storage unit 215 and/or a sequence information obtaining unit 216. Note that the eating-drinking environment information providing system 200 performs information processing by any electronic control device functioning as a processing unit 205. The eating-drinking environment control system 100 includes any storage device that stores various types of information.

The food surrounding environment information storage unit 210 stores, for each food product, food surrounding environment information including at least a temperature and/or a humidity in association with the food product. "Food surrounding environment information" is defined by the optimum values of respective items, such as the temperature, the humidity, the volume of airflow, and the direction of airflow in the surrounding environment, that affect the food product. However, food surrounding environment information is not limited to this and may be defined by, for example, the temperature and/or humidity of the food product itself. Food surrounding environment information is associated with a food product; however, different values may be used depending on not only the food product but also the condition of the person, or different values may be used depending on the individual. For example, for a person who has had a run, values different from those for a person who has not had a run can be employed. Note that food surrounding environment information can be updated by an input operation by a system user or can be automatically updated on the basis of external data, such as customer satisfaction.

The food surrounding environment information storage unit 210 stores, for each food product, the best-before time of the food product corresponding to a predetermined food surrounding environment. Note that "each food product" mentioned here is a food category that can be set by the system user as desired and, for example, hot noodles and cold noodles can be separately categorized and set although the noodles are the same food products. Further, "best-before time" is not related to food safety but is the time before which the food product tastes good. For example, the best-before time of wine is determined with reference to the degree of taste deterioration in one hour when the temperature of the eating-drinking environment is 16° C. Therefore, for typical wine, the best-before time is shorter than one hour when the temperature of the eating-drinking environment is 20° C. Note that this is only an example, and the reference for the best-before time can be set by the system user as desired.

The sequence information storage unit 215 stores in advance information about the sequence in which a plurality of food products are to be served.

The sequence information obtaining unit 216 obtains information about the sequence in which a plurality of food products are to be served. Here, the sequence information obtaining unit 216 sends the obtained information about the sequence of the food products to the food surrounding environment information providing unit 240.

The served-food information obtaining unit 220 obtains via any input device, information about a food product that is served in the eating-drinking environment. The served-food information obtaining unit 220 sends the obtained information about the food product to the food surrounding environment information providing unit 240. Specifically, the served-food information obtaining unit 220 can be implemented as an image data obtaining unit 221 that obtains an image of a food product served to a user having a meal. The served-food information obtaining unit 220 can also be implemented as a food accepting unit 222 that accepts input of information indicating a certain food product. Note that the food accepting unit 222 may accept information about a food product via an information terminal that can perform communication by wire or wirelessly. Further, the food accepting unit 222 may accept information about a food product input by voice. In addition, the food accepting unit 222 may accept information about a food product via, for example, a tablet or a smart device that accepts an ordered menu or a remote controller of an air conditioner or may obtain information about a food product by reading an identifier (for example, a bar code) attached to the food container.

The food surrounding environment information providing unit 240 outputs to an external apparatus a food surrounding environment desired value corresponding to at least a temperature and/or a humidity on the basis of food surrounding environment information. Here, the food surrounding environment information providing unit 240 outputs the food surrounding environment desired value to the eating-drinking environment change apparatus 300. Note that "food surrounding environment desired value" described here is a control value for controlling a component device (for example, an actuator) that constitutes the eating-drinking environment change apparatus 300 and is defined by a control value for achieving an eating-drinking environment having at least a predetermined temperature and/or humidity.

Specifically, the food surrounding environment information providing unit 240 uses information about a food product obtained by the served-food information obtaining unit 120 to extract food surrounding environment information from the food surrounding environment information storage unit 110. The food surrounding environment information providing unit 240 calculates a food surrounding environment desired value on the basis of the extracted food surrounding environment information. The food surrounding environment information providing unit 240 has a function of outputting a food surrounding environment desired value on the basis of the best-before time of the certain food product. The food surrounding environment information providing unit 240 has a function of outputting a food surrounding environment desired value on the basis of the sequence in which food products are to be served and food surrounding environment information. Further, the food surrounding environment information providing unit 240 has a function of outputting a food surrounding environment desired value including a temperature and/or a humidity on the basis of the position of the food product and/or the position of the user having a meal.

Figure 6:
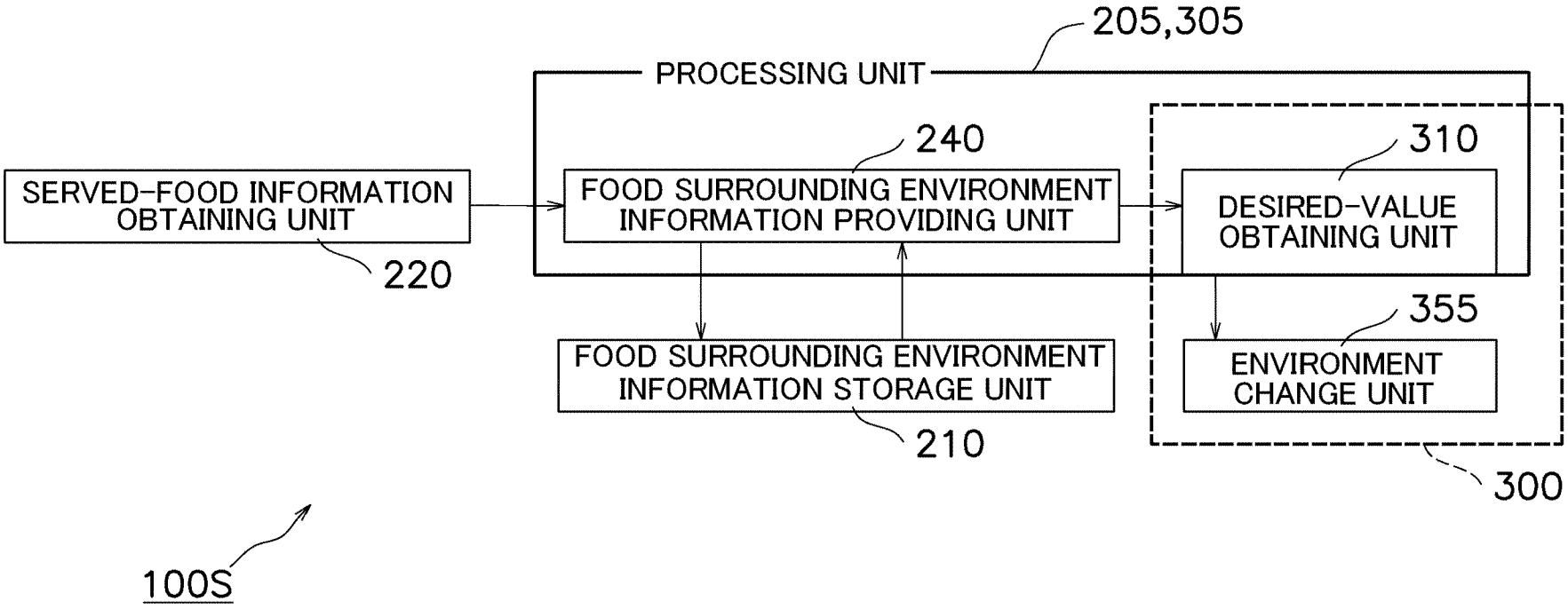
FIG. 6 is a schematic diagram for describing a configuration of an eating-drinking environment change apparatus 300 according to the second embodiment.

As illustrated in FIG. 6, the eating-drinking environment change apparatus 300 includes at least a desired-value obtaining unit 310 and an environment change unit 355. The eating-drinking environment change apparatus 300 may further include a setting change unit 356 and a position detection unit 361. The eating-drinking environment change apparatus 300 thus configured can be implemented as an air conditioner 360 and/or a meal serving table 370 having a surface part for which the temperature can be regulated. Note that the eating-drinking environment change apparatus 300 performs information processing by any electronic control device functioning as a processing unit 305. Further, the eating-drinking environment control system 100 includes any storage device that stores various types of information. Note that the functions of the eating-drinking environment change apparatus 300 may be implemented by the eating-drinking environment change apparatus 300 itself or may be implemented by the eating-drinking environment information providing system 200 and the eating-drinking environment change apparatus 300 cooperating with each other.

The desired-value obtaining unit 310 obtains a food surrounding environment desired value output from the food surrounding environment information providing unit 240 of the eating-drinking environment information providing system 200.

The environment change unit 355 changes the eating-drinking environment on the basis of the food surrounding environment desired value. Here, the environment change unit 355 changes the state of the eating-drinking environment on the basis of information about a food product obtained by the served-food information obtaining unit 220. For example, the environment change unit 355 changes the state of the eating-drinking environment by controlling the actuator of the air conditioner 360.

The setting change unit 356 accepts a change in a setting for controlling the eating-drinking environment.

The position detection unit 361 detects the position of a food product and/or the position of a user having a meal. Note that the position detection unit 361 may detect the position of a food product not by detecting the food product itself but by detecting the container of the food product and assuming the position of the container of the food product to be the position of the food product. In a case where the position at which a food product is put is stored in advance in the storage device, the position detection unit 361 may obtain the position of the food product from the information stored in the storage device. Note that the position detection unit 361 and the image data obtaining unit 221 can use the same image capturing device.

Figure 7:
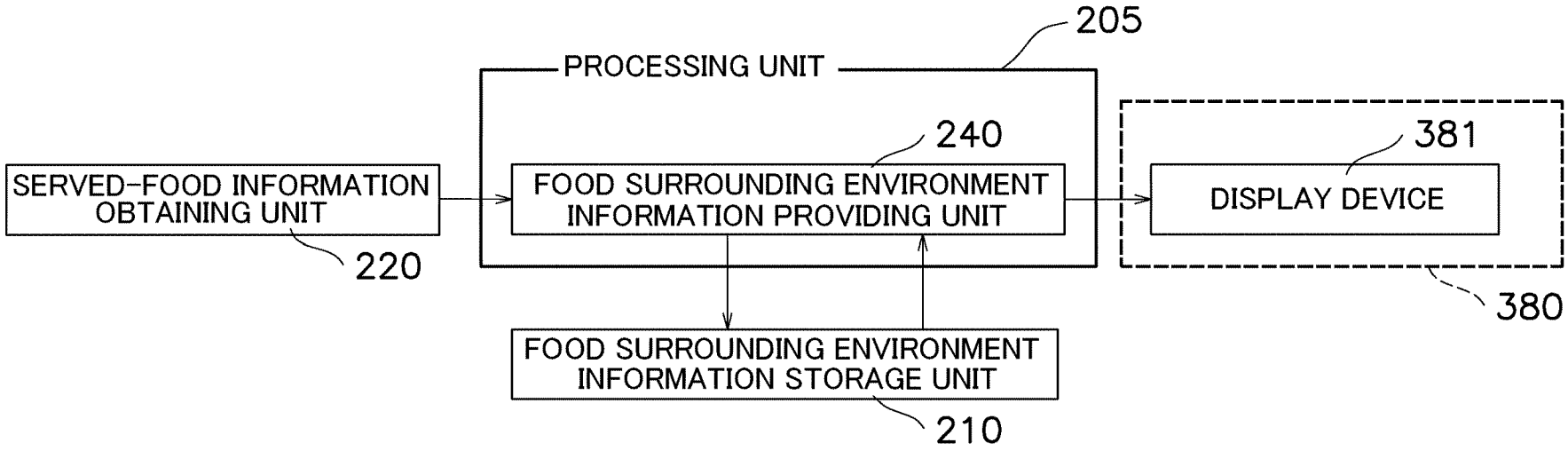
FIG. 7 is a schematic diagram for describing a configuration of the eating-drinking environment information providing system 200 according to a modification of the second embodiment.

In the description given above, the eating-drinking environment information providing system 200 outputs a food surrounding environment desired value to the eating-drinking environment change apparatus 300; however, the configuration of the eating-drinking environment information providing system 200 according to this embodiment is not limited to this. For example, as illustrated in FIG. 7, the eating-drinking environment information providing system 200 may output information related to an eating-drinking surrounding environment desired value not to the eating-drinking environment change apparatus 300 but to a display unit 381 of an output device 380, which is any device. Accordingly, on the output device 380, which is any output device, information about an optimum temperature and/or humidity for the food product served in the eating-drinking environment and related information can be displayed.

(2-2)

As described above, the eating-drinking environment information providing system 200 according to the second embodiment includes the food surrounding environment information storage unit 210 and the food surrounding environment information providing unit 240 and outputs a food surrounding environment desired value including a temperature and/or a humidity on the basis of food surrounding environment information. With this configuration, the eating-drinking environment information providing system 200 can output to an external apparatus (for example, the eating-drinking environment change apparatus 300) the food surrounding environment desired value with which satisfaction with the meal can be increased.

In the eating-drinking environment information providing system 200, the food surrounding environment information providing unit 240 has the function of outputting a food surrounding environment desired value on the basis of the sequence in which food products are to be served and food surrounding environment information, and therefore, a food surrounding environment desired value that takes into consideration the combination of the plurality of food products can be output. Further, the eating-drinking environment change apparatus 300 controls the eating-drinking environment on the basis of the sequence in which food products are to be served and food surrounding environment information, and therefore, the eating-drinking environment suitable to the combination of the plurality of food products can be achieved. Specifically, in a case where, for example, a course is served, the state of the eating-drinking environment can be regulated in accordance with the progress in the meal. For example, in a situation where a Hamburg steak is served after a salad, for example, the temperature of the eating-drinking environment can be regulated so as to extend the best-before time of the Hamburg steak and to keep the Hamburg steak tasty.

In the eating-drinking environment information providing system 200, the food surrounding environment information storage unit 210 stores, for each food product, the best-before time of the food product corresponding to a predetermined food surrounding environment, and therefore, an eating-drinking environment desired value that matches the best-before time of a certain food product can be output. Further, the eating-drinking environment change apparatus 300 can control the eating-drinking environment in accordance with the best-before time of the certain food product on the basis of the food surrounding environment desired value. In other words, the eating-drinking environment can be regulated so as to achieve, for example, an optimum temperature in accordance with the change rate of the quality of the food expenses (best-before time). For example, in a situation where a wine for which the best-before time is one hour in an eating-drinking environment in which the temperature is 15° C. is served, when the temperature is changed to 10° C. after the elapse of 30 minutes since the serving of the wine, the best-before time of the wine can be regulated so as to be extended to, for example, two hours.

Further, the eating-drinking environment information providing system 200 includes the served-food information obtaining unit 220 that obtains information about a food product that is served in the eating-drinking environment, and therefore, a food surrounding environment desired value corresponding to the food product that is served in the eating-drinking environment can be output. Further, the eating-drinking environment change apparatus 300 can control the eating-drinking environment in accordance with the food product that is served in the eating-drinking environment on the basis of the food surrounding environment desired value.

Specifically, in a case where the served-food information obtaining unit 220 includes the image data obtaining unit 221, a food surrounding environment desired value can be output on the basis of an image of a food product that is served in the eating-drinking environment. Accordingly, the eating-drinking environment change apparatus 300 can control the eating-drinking environment on the basis of the food surrounding environment desired value.

In a case where the served-food information obtaining unit 220 includes the food accepting unit 222, a food surrounding environment desired value can be output on the basis of a food product that is served in the eating-drinking environment. Accordingly, the eating-drinking environment change apparatus 300 can control the eating-drinking environment on the basis of the food surrounding environment desired value.

Further, the eating-drinking environment change apparatus 300 according to the second embodiment obtains a food surrounding environment desired value output from the food surrounding environment information providing unit 240 of the eating-drinking environment information providing system 200 and controls the eating-drinking environment on the basis of the food surrounding environment desired value, and therefore, satisfaction with the meal can be increased.

Further, the eating-drinking environment change apparatus 300 includes the air conditioner 360 and/or the meal serving table 370. The meal serving table 370 can regulate the temperature distribution of the surface part, and therefore, the ambient temperature of the food product can be precisely regulated in accordance with the position on the surface part. For example, the meal serving table 370 controls the temperature of the surface part on which a utensil is put to thereby regulate the ambient temperature of the food product.

In a case where the eating-drinking environment change apparatus 300 is implemented as the air conditioner 360, the eating-drinking environment change apparatus 300 includes the position detection unit 361 that detects the position of a food product and/or the position of a user having a meal, and therefore, the eating-drinking environment can be changed in accordance with the position of the food product and/or the position of the user. Specifically, the air conditioner 360 can send conditioned air so as to pass around the food product or can send conditioned air so as to pass around the user having a meal. Instead, the air conditioner 360 can send conditioned air toward the food product or can send conditioned air toward the user having a meal.

Further, the eating-drinking environment change apparatus 300 includes the setting change unit 356 that changes a setting for changing the eating-drinking environment, and therefore, the eating-drinking environment can be changed so as to reflect the intention of the system user. For example, even in a case where a food product (for example, a wine) that is colder than the room temperature is served and cold air is sent from the air conditioner 360 in order to maintain the quality of the food product, for example, the user having a meal can change a setting of the air conditioner 360 via the setting change unit 356, and therefore, the possibility of the user having a complaint about an excessive chill can be reduced. In other words, when the setting change unit 356 is provided, a measure against, for example, an excessive chill can be implemented, and the possibility of the user's comfort being compromised can be reduced.

Note that the eating-drinking environment control system 100S may be configured to detect the temperature of a food product and feed the temperature back to the eating-drinking environment change apparatus 300. With this configuration, the eating-drinking environment change apparatus 300 can regulate the eating-drinking environment so as to achieve an optimum state on the basis of the detected temperature of the food product and food surrounding environment information.

Hereinafter, example application of the above-described eating-drinking environment control system is described. Note that in the following description, a matter that has already been described is assigned the same reference numeral, and a description thereof is omitted. In a case of giving a description of a new component or giving an additional description to a component that has already been described, an additional letter T is appended in the description.

(3-1) Configuration of Eating-Drinking Environment Control System 100T

Figure 8:
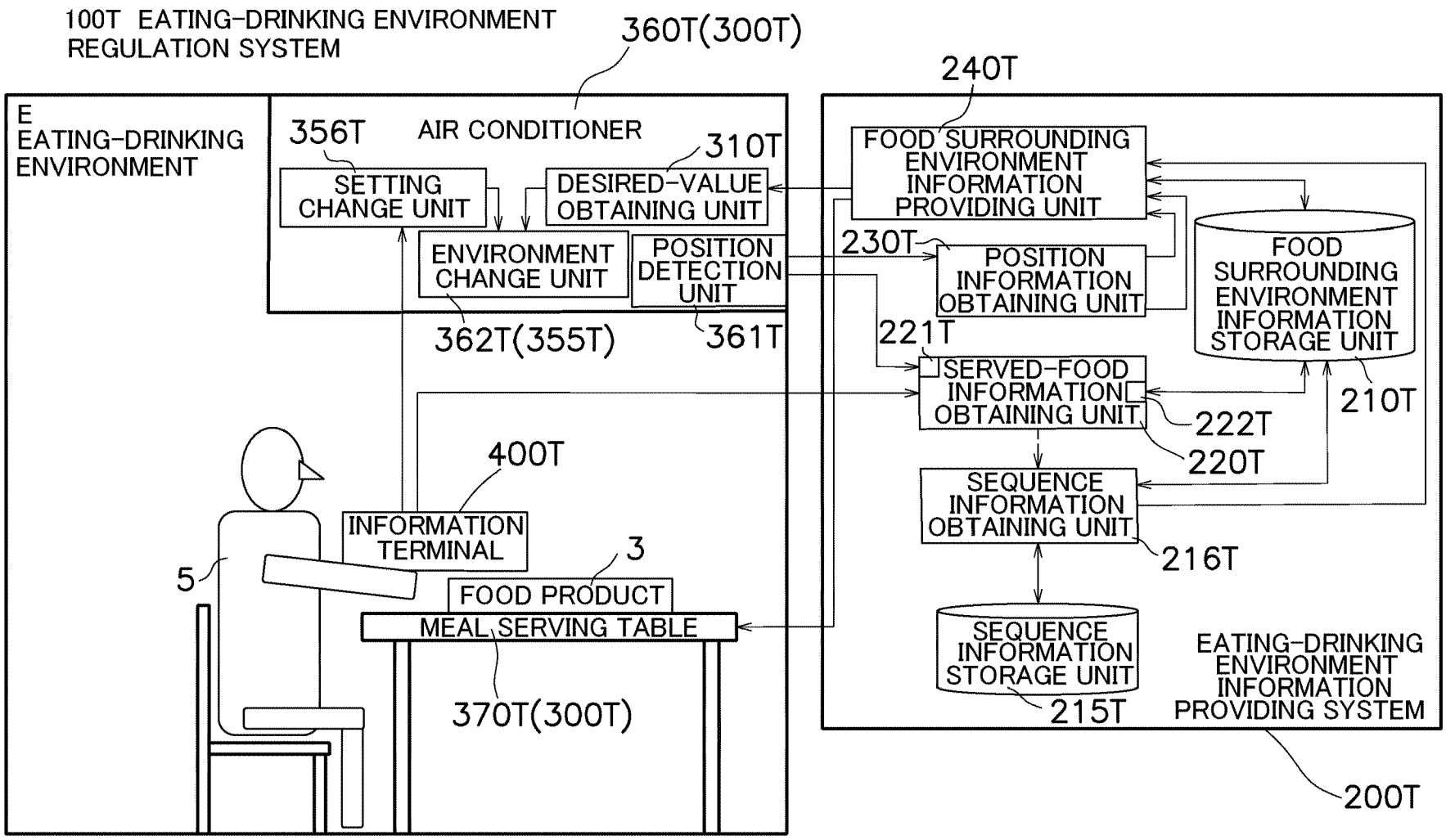
FIG. 8 is a schematic diagram illustrating a configuration of an eating-drinking environment control system 100T according to example application.

FIG. 8 is a schematic diagram illustrating a configuration of an eating-drinking environment control system 100T according to the example application. The eating-drinking environment control system 100T includes an eating-drinking environment information providing system 200T and an eating-drinking environment change apparatus 300T.

The eating-drinking environment information providing system 200T includes a food surrounding environment information storage unit 210T, a sequence information storage unit 215T, a sequence information obtaining unit 216T, a served-food information obtaining unit 220T, a position information obtaining unit 230T, and a food surrounding environment information providing unit 240T. Note that the eating-drinking environment information providing system 200T performs information processing by any electronic control device functioning as a processing unit. The eating-drinking environment information providing system 200T includes any storage device that stores various types of information. Here, a program stored in the storage device (for example, a ROM or a RAM) is read by, for example, a CPU (central processing unit) of a computer to thereby implement the above-described functions. However, the implementation of the functions is not limited to this, and the electronic control device may be implemented as hardware by using, for example, an LSI (large-scale integration) circuit, an ASIC (application-specific integrated circuit), or an FPGA (field-programmable gate array).

Figure 9:
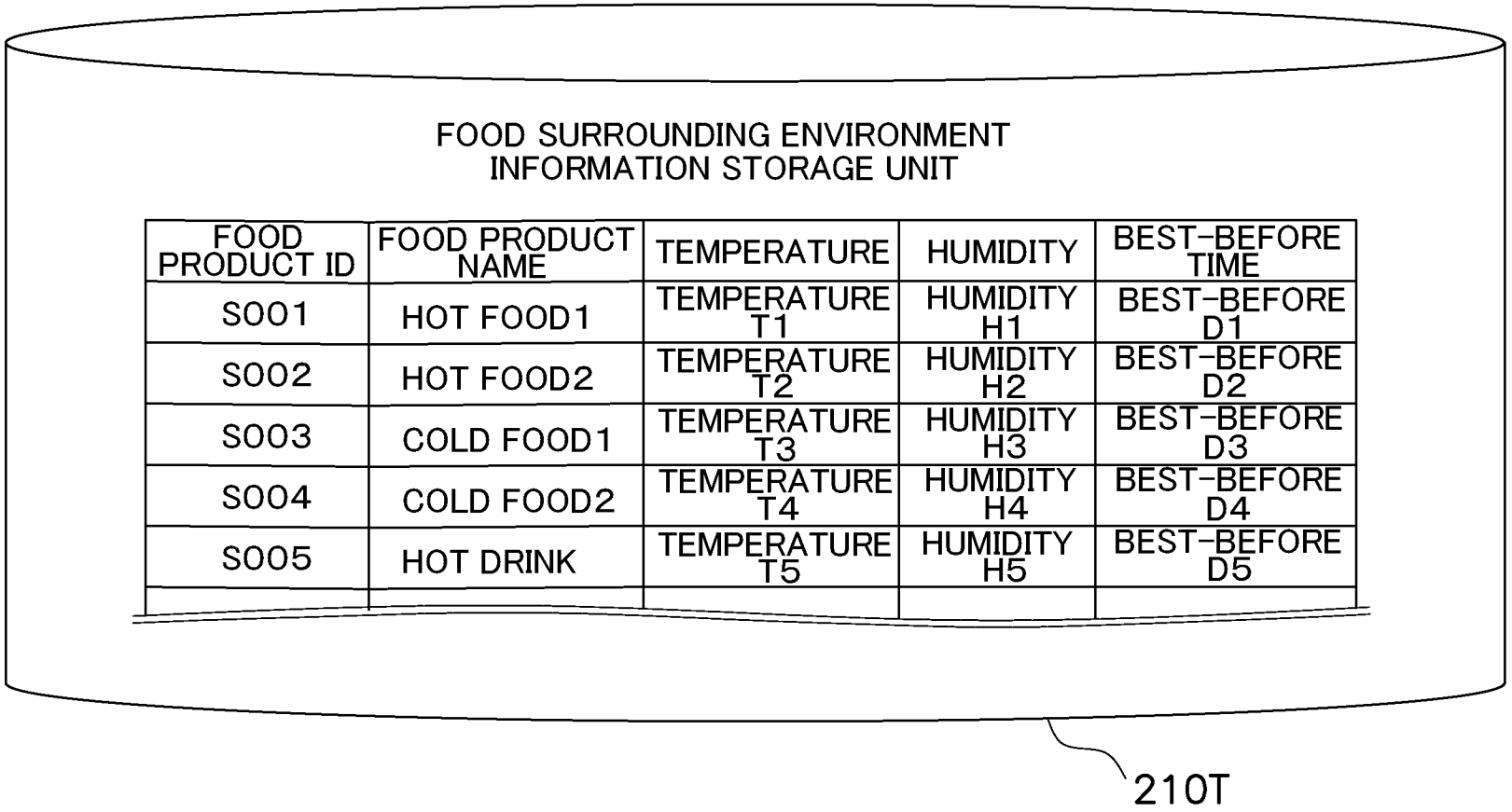
FIG. 9 is a schematic diagram for describing a database structure of a food surrounding environment information storage unit 210T according to the example application.

The food surrounding environment information storage unit 210T stores, for each food product, optimum food surrounding environment information including at least a temperature and/or a humidity in association with the food product. Specifically, the food surrounding environment information storage unit 210T includes a database as illustrated in FIG. 9 and stores, for example, a food product name, a temperature, a humidity, and a best-before time in association with a food product ID for uniquely identifying a food product. Note that information illustrated in FIG. 9 is an example for description, and information stored in the food surrounding environment information storage unit 210T is not limited to that illustrated in the figure.

Figure 10:
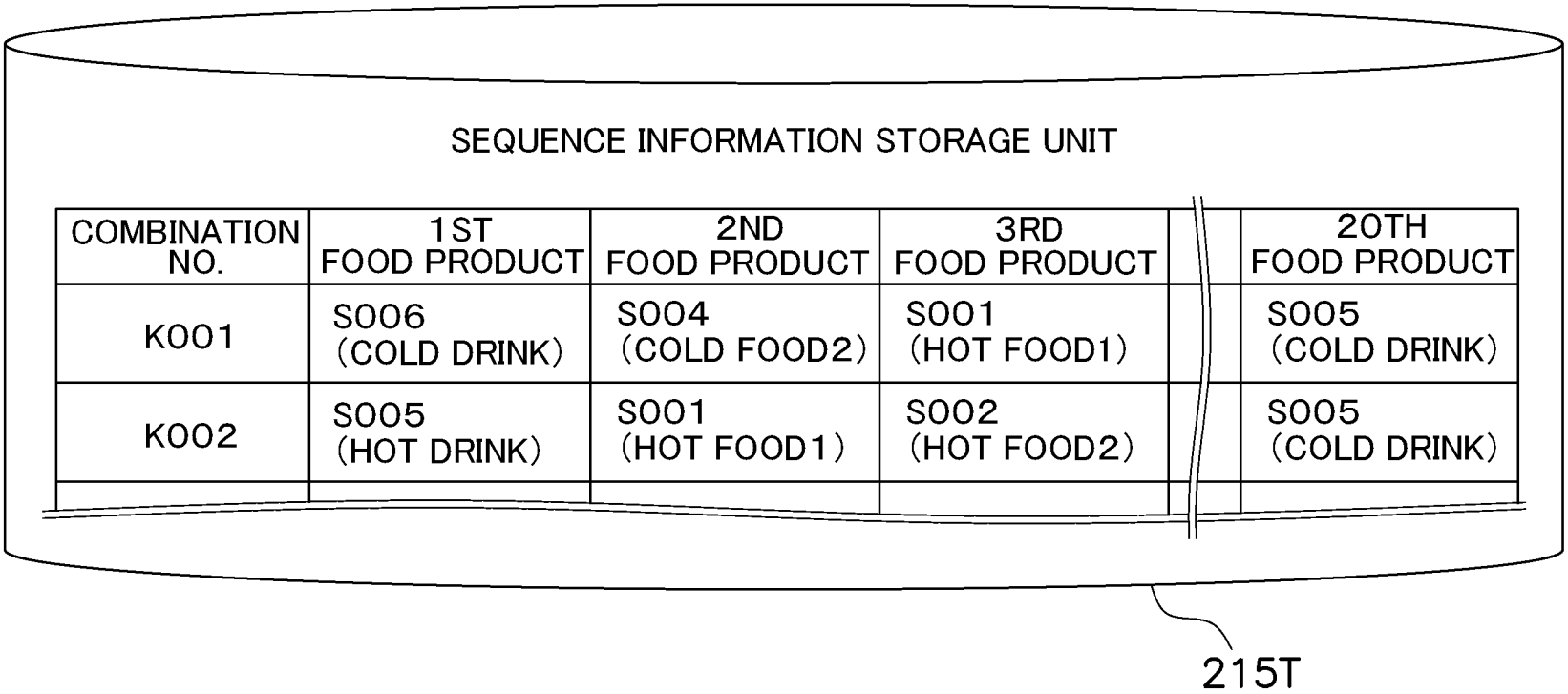
FIG. 10 is a schematic diagram for describing a database structure of a sequence information storage unit 215T according to the example application.

The sequence information storage unit 215T stores in advance information about the sequence in which a plurality of food products are to be served. Specifically, the sequence information storage unit 215T includes a database as illustrated in FIG. 10 and stores food product IDs for identifying the first to i-th food products (i is a natural number larger than 1) in association with a combination number for uniquely identifying the combination of the plurality of food products.

The sequence information obtaining unit 216T obtains information about the sequence in which a plurality of food products are to be served.

The served-food information obtaining unit 220T obtains via any input device, information about a food product 3 that is served in an eating-drinking environment E. The served-food information obtaining unit 220 sends the obtained information about the food product 3 to the food surrounding environment information providing unit 240T. Specifically, the served-food information obtaining unit 220T can be implemented as an image data obtaining unit 221T and/or a food accepting unit 222T.

The position information obtaining unit 230T obtains position information indicating the position of the food product 3 and/or the position of a user 5 having a meal. Here, the position information obtaining unit 230T obtains the position information on the basis of information sent from a position detection unit 361T described below. Alternatively, the position information obtaining unit 230T obtains the position information on the basis of information sent from an information terminal 400T that is placed at a predetermined position. Further, the position information obtaining unit 230T sends the obtained position information to the food surrounding environment information providing unit 240T.

The food surrounding environment information providing unit 240T outputs to an external apparatus a food surrounding environment desired value on the basis of food surrounding environment information. Here, the food surrounding environment information providing unit 240T outputs a food surrounding environment desired value to the eating-drinking environment change apparatus 300T. The food surrounding environment information providing unit 240T has a function of calculating the food surrounding environment desired value on the basis of the position information sent from the position information obtaining unit 230T.

The eating-drinking environment change apparatus 300T includes at least a desired-value obtaining unit 310T, an environment change unit 355T, and a setting change unit 356T. Note that the eating-drinking environment change apparatus 300T performs information processing by any electronic control device functioning as a processing unit. The eating-drinking environment change apparatus 300T includes any storage device that stores various types of information. The electronic control device may be implemented as hardware by using, for example, an LSI (large-scale integration), an ASIC (application-specific integrated circuit), or an FPGA (field-programmable gate array) or may be implemented as a program that is stored in the storage device (for example, a ROM or a RAM) and read by, for example, a CPU (central processing unit) of a computer.

The desired-value obtaining unit 310T obtains the food surrounding environment desired value output from the food surrounding environment information providing unit 240T of the eating-drinking environment information providing system 200T.

The environment change unit 355T changes the state of the eating-drinking environment on the basis of the food surrounding environment desired value.

The setting change unit 356T accepts a change in a setting for controlling the eating-drinking environment E. Here, for example, the user 5 can use the information terminal 400T that allows input and output of information, and a change in a setting described above is accepted via the information terminal 400T.

Specifically, the eating-drinking environment change apparatus 300T is implemented as an air conditioner 360T. Here, the air conditioner 360T includes the position detection unit 361T formed of any image capturing device. The environment change unit 355T functions as a conditioned-air control unit 362T. Here, the conditioned-air control unit 362T controls, for example, the direction of airflow and the volume of airflow on the basis of the position information indicating the position of the food product 3 and/or the position of the user 5 detected by the position detection unit 361T. Note that the conditioned-air control unit 362T may perform control directly on the basis of the position information detected by the position detection unit 361T, or the position information may be transmitted to the eating-drinking environment information providing system 200T and the transmitted information is received by the conditioned-air control unit 362T to thereby perform control on the basis of the received information.

The eating-drinking environment change apparatus 300T may be formed of the meal serving table 370T. Here, the meal serving table 370T has a surface part for which the temperature distribution can be regulated. When the temperature of the surface part of the meal serving table 370 is regulated, for example, the best-before time of a food product hotter than the room temperature and/or the best-before time of a food product colder than the room temperature can be extended.

(3-2) Operations of Eating-Drinking Environment Control System 100T

Figure 11:
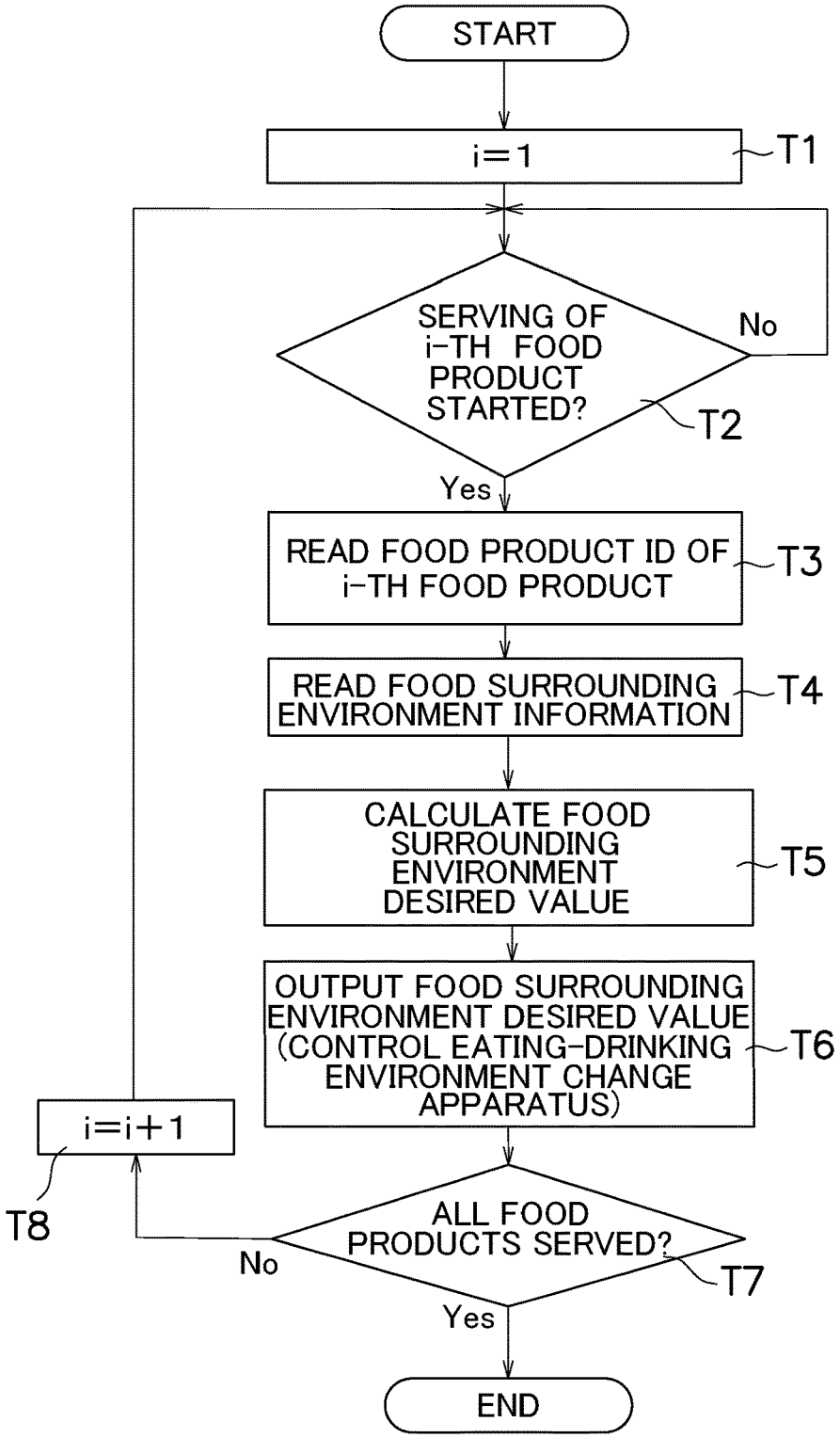
FIG. 11 is a flowchart for describing operations of the eating-drinking environment control system 100T according to the example application.

FIG. 11 is a flowchart for describing operations of the eating-drinking environment control system 100T according to this embodiment.

First, the computer of the eating-drinking environment information providing system 200T determines whether the food product 3 is served on the meal serving table 370T, which is a predetermined table (T1, T2). Here, start information indicating the start of serving of the food product 3 is input to the computer of the eating-drinking environment information providing system 200T by a food server. However, determination is not limited to this, and determination as to whether serving of the food product 3 is started may be performed by the position detection unit 361T detecting the food product 3.

In a case where the computer of the eating-drinking environment information providing system 200T determines that the food product 3 has been served on the meal serving table 370T, the computer reads the food product ID of the first (i=1) food product 3 from the sequence information storage unit 215T (Yes in T2, T3). Subsequently, the computer of the eating-drinking environment information providing system 200T reads food surrounding environment information corresponding to the food product ID of the first (i=1) food product 3 from the food surrounding environment information storage unit 210T (T4).

Next, the computer of the eating-drinking environment information providing system 200 T calculates a food surrounding environment desired value for controlling the eating-drinking environment change apparatus 300T on the basis of the food surrounding environment information by using the function of the food surrounding environment information providing unit 240T (T5). The computer of the eating-drinking environment information providing system 200T outputs the food surrounding environment desired value to the eating-drinking environment change apparatus 300T (T6).

When receiving the food surrounding environment desired value from the computer of the eating-drinking environment information providing system 200T, the eating-drinking environment change apparatus 300T changes the state of the eating-drinking environment E in accordance with the food surrounding environment desired value. For example, in a case where a cold drink is served as the food product 3, the eating-drinking environment change apparatus 300T decreases the temperature of the conditioned air of the air conditioner 360T or decreases the temperature of the surface part of the meal serving table 370T.

Thereafter, the computer of the eating-drinking environment information providing system 200T repeats the operations from T2 to T8 described above until serving of all food products 3 is completed (T7-No).

Here, until end information indicating the end of serving of the i-th food product 3 is input to the computer of the eating-drinking environment information providing system 200T by the food server, the eating-drinking environment change apparatus 300T is controlled on the basis of the food environment desired value corresponding to the i-th food product 3. When start information indicating the start of serving of the i+1-th food product 3 is input, it may be assumed that end information indicating the end of serving of the i-th food product 3 is input. Determination as to whether serving of the food product 3 is completed may be performed on the basis of the fact that the position detection unit 361T has not detected the food product 3 for a predetermined time or more instead of input of end information by the meal server.

Note that in a case where a plurality of food products 3 that form a combination are successively served, the second and subsequent food products 3 may be served on the basis of their respective best-before times. Accordingly, the processes in steps T2 and T7 for the second and subsequent food products 3 can be omitted.

(3-3) Features of Eating-Drinking Environment Control System 100T (3-3-1)

As described above, the eating-drinking environment control system 100T according to the example application includes the eating-drinking environment information providing system 200T and the eating-drinking environment change apparatus 300T. When the food product 3 is served in the eating-drinking environment E, the eating-drinking environment information providing system 200T determines a setting (for example, a temperature of 20° C.) for the state of the eating-drinking environment E (for example, the temperature, the humidity, the direction of airflow, and the airflow velocity) on the basis of food surrounding environment information including at least one of the temperature or the humidity set for each type of food product 3. The eating-drinking environment change apparatus 300T regulates the state of the eating-drinking environment so as to maintain the setting. Accordingly, satisfaction of the user 5 having a meal can be increased.

The eating-drinking environment change apparatus 300 includes the air conditioner 360. Therefore, the eating-drinking environment control system 100T can control the conditioned air in the eating-drinking environment E on the basis of food surrounding environment information that is associated with each food product 3.

In the example application, the air conditioner 360T (eating-drinking environment change apparatus 300T) includes the position detection unit 361 that detects the position of a food product and/or the position of a user having a meal. Therefore, the air conditioner 360T can control the direction of airflow and/or the volume of airflow of the conditioned air in the eating-drinking environment E in accordance with the position of the food product 3 and/or the position of the user 5.

For example, in a case where the food product 3 (for example, a wine) that is colder than the room temperature is served, the eating-drinking environment control system 100T according to the example application can control the direction of airflow of the air conditioner 360T such that cold air blows against the food product 3 and cold air does not blow against the user 5. Accordingly, the best-before time of the food product 3 can be extended, and the possibility of comfort of the user 5 being compromised can be reduced.

Note that position information detected by the position detection unit 361T of the air conditioner 360T is transmitted to the eating-drinking environment information providing system 200T. In response to this, the food surrounding environment information providing unit 240T of the eating-drinking environment information providing system 200T returns a food surrounding environment desired value including a temperature and/or a humidity to the air conditioner 360T on the basis of the position information indicating the position of the food product 3 and/or the position of the user 5. Accordingly, the air conditioner 360T changes the state of the eating-drinking environment E on the basis of the position information.

(3-3-2)

The eating-drinking environment change apparatus 300T according to the example application includes the meal serving table 370T having the surface part for which the temperature distribution can be regulated. With this configuration, the ambient temperature of the food product 3 can be precisely regulated in accordance with the position on the surface part. As a result, the food ambient temperature can be precisely regulated in accordance with the type of the food product 3.

For example, in a case where the food product 3 (for example, a hot-pot dish) hotter than the room temperature is served on the meal serving table 370T, the eating-drinking environment control system 100T according to the example application can control the direction of airflow of the air conditioner 360T such that the surface part on which the food product 3 is served is made hot and cold air blows against the user 5 having a meal. Accordingly, the best-before time of the food product 3 can be extended, and the possibility of comfort of the user 5 being compromised can be reduced.

(3-4) Modifications of Eating-Drinking Environment Control System 100T (3-4-1)

The eating-drinking environment information providing system 200T according to the example application may include a remaining time calculation unit that calculates the remaining time of the best-before time on the basis of the time elapsed since the start of serving of the food product 3 and the initial temperature at the start of serving of the food product 3. With this configuration, when the food product 3 is served in the eating-drinking environment E, the eating-drinking environment E can be regulated such that the best-before time is extended. In other words, when the best-before time is extended, the possibility of the taste of the food product 3 being deteriorated can be reduced to the extent possible.

(3-4-2)

Further, in the eating-drinking environment information providing system 200T, the information terminal 400T may output the remaining time of the best-before time and food surrounding environment information. Further, the information terminal 400T may detect, for example, the current temperature of the eating-drinking environment E and output information based on a comparison between, for example, the detected temperature and food surrounding environment information. When the information terminal 400T thus configured is used, it is possible to make, for example, the user 5 having a meal and the food server aware of the remaining time of the best-before time and the food surrounding environment information. For example, the information terminal 400T presents the best-before time as is, presents the remaining time, or presents the level of taste corresponding to the elapsed time. Further, the information terminal 400T can present, for example, whether the food product 3 is in a state where the food product 3 tastes good, on the basis of the remaining time.

(3-4-3)

In the information terminal 400T, a setting change unit that accepts a change in an eating-drinking environment desired value for the eating-drinking environment change apparatus 300T may be incorporated. Further, in a case where the setting change unit accepts a change in an eating-drinking environment desired value, the eating-drinking environment information providing system 200T may calculate the remaining time of the best-before time, and the information terminal 400T may output the remaining time of the best-before time and the state value of the eating-drinking environment E. With this configuration, it is possible to make, for example, the user 5 having a meal and the food server aware of a change in the remaining time resulting from the change in the eating-drinking environment desired value for the eating-drinking environment E.

Further, the information terminal 400T may output information related to the electricity cost of the eating-drinking environment change apparatus 300T in addition to the best-before time. With this configuration, it is possible to make, for example, the food server aware of the information about the electricity cost.

(3-4-4)

Further, in a case where the information terminal 400T outputs the remaining time of the best-before time and a setting of the eating-drinking environment E, the eating-drinking environment information providing system 200T may ask, via the information terminal 400T, for permission to change a control value of the eating-drinking environment change apparatus 300T. With this configuration, the eating-drinking environment E that matches the intention of, for example, the user 5 having a meal can be provided. Specifically, in order to extend the remaining time of the best-before time, a control value of the eating-drinking environment change apparatus 300T can be adjusted such that the eating-drinking environment E becomes less comfortable. For example, in order to extend the remaining time of the best-before time of a wine, a control value of the air conditioner 360T can be adjusted such that the temperature of the eating-drinking environment E is changed from 20° C. at which the degree of comfort is high to 16° C. at which the degree of comfort is low.

(3-4-5)

Further, in the eating-drinking environment control system 100T, the air conditioner 360T may have a function of regulating the humidity of the conditioned air so as to suppress condensation on the meal serving table 370T. Accordingly, even in a case where the surface of the meal serving table 370T is cooled, it is possible to prevent condensation from occurring on the meal serving table 370. As a result, the eating-drinking environment E can be made more comfortable.

(3-4-6)

Figure 12:
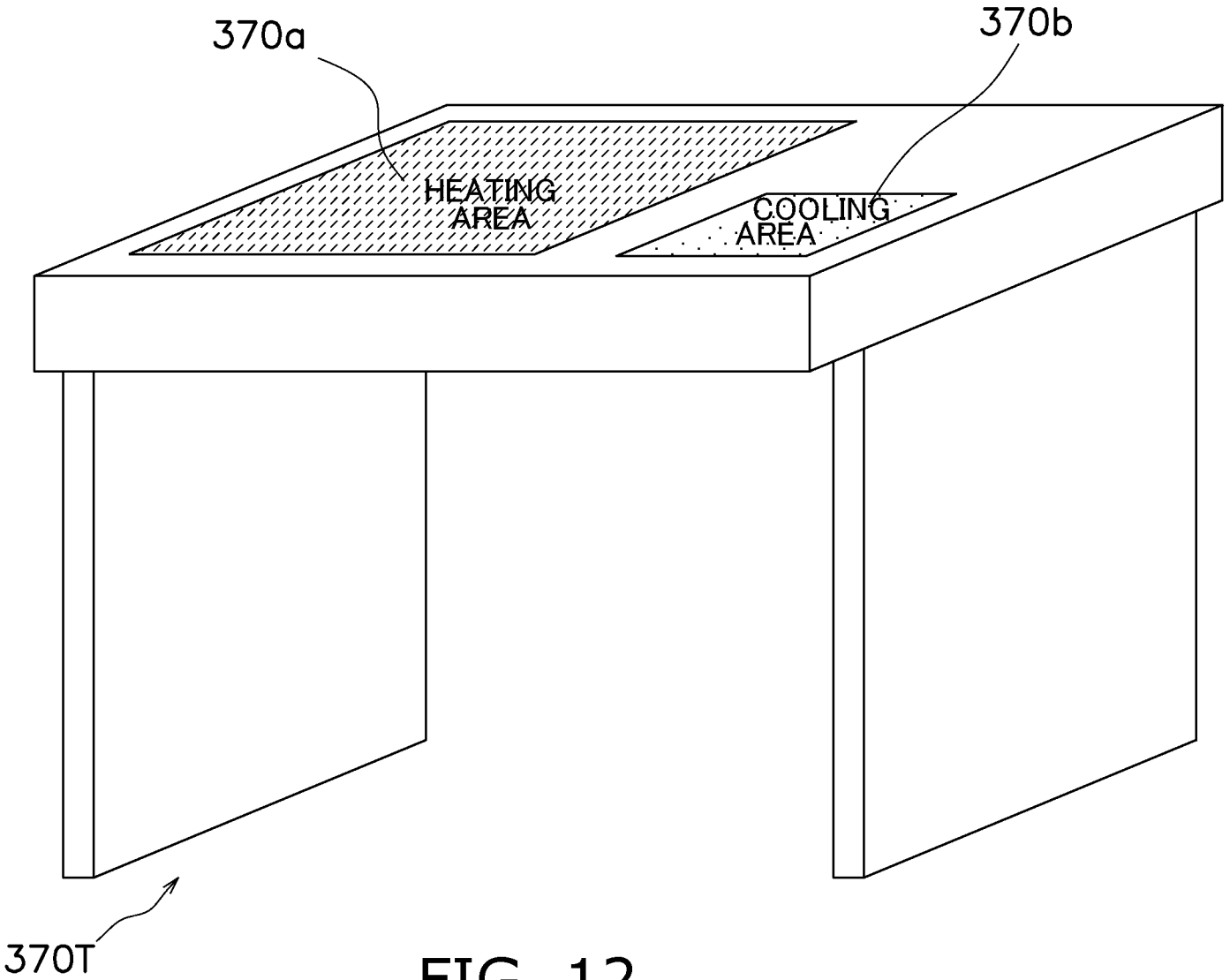
FIG. 12 is a schematic diagram illustrating an example configuration of a meal serving table 370T according to the example application.

On the meal serving table 370T described above, at least a heating area 370*a* and a cooling area 370*b* may be formed on the surface as illustrated in FIG. 12. The heating area 370*a* and the cooling area 370*b* may be formed by using a heating absorbing part and a heat generating part of one member. One member described here means any heat pump device or a Peltier device. With this configuration, exhaust heat from the heat absorbing part can be used by the heat generating part, and therefore, a system having high energy efficiency can be provided.

(3-4-7)

Further, the eating-drinking environment information providing system 200T may include a priority storage unit that stores the priority degrees of a plurality of food products 3. In this case, in a case where a plurality of food products 3 are present in the eating-drinking environment E, the food surrounding environment information providing unit 240T determines a food environment desired value in the eating-drinking environment E on the basis of the priority degrees of the food products 3. With this configuration, the eating-drinking environment E can be regulated so as to be suitable to the combination of the plurality of food products 3.

(3-4-8)

Further, the eating-drinking environment information providing system 200T may include a useful-information storage unit that stores a combination of a plurality of food products 3 and useful information in association with each other. In this case, the food surrounding environment information providing unit 240T outputs the useful information concerning the combination of the plurality of food products 3. With this configuration, it is possible to make, for example, the user 5 and the food server aware of the useful information corresponding to the combination of the plurality of food products 3. For example, in a case where a hotpot and a wine are simultaneously ordered, the food surrounding environment information providing unit 240 T outputs to the information terminal 400, information stating that, for example, "you are recommended to reconsider your order because the possibility of simultaneously satisfying an eating-drinking environment for the hotpot and that for the wine is low".

Other Embodiment(s)

Although embodiments have been described above, it should be understood that various changes can be made to the embodiments or specifics without departing from the spirit and scope of the claims.

That is, the present disclosure is not limited to the above-described embodiments as is. The present disclosure can be embodied by modifying the components without departing from the spirit thereof in the implementation phase. Further, the present disclosure can form various disclosures by combining a plurality of components disclosed in the above-described embodiments as appropriate. For example, some components may be deleted from all components illustrated in an embodiment. Further, components in different embodiments may be combined as appropriate.

The invention claimed is:

1. An eating-drinking environment control system comprising:

a food surrounding environment information storage unit that stores, for each of a plurality of food products, food surrounding environment information including an absolute value of a temperature and a humidity in association with the food product; and an environment control unit configured to control an eating-drinking environment based on the food surrounding environment information.

2. The eating-drinking environment control system according to claim 1, wherein the environment control unit includes an air conditioner.

3. The eating-drinking environment control system according to claim 2, wherein the air conditioner includes a position detection unit that detects one or both of a position of a food product and a position of a user having a meal and controls a direction of airflow and a volume of airflow based on the one or both of the position of the food product and the position of the user.

4. The eating-drinking environment control system according to claim 1, wherein the environment control unit includes a meal serving table that has a surface part for which temperature regulation is possible.

5. The eating-drinking environment control system according to claim 4, wherein for the surface part, temperature distribution regulation is possible.

6. The eating-drinking environment control system according to claim 1, wherein the food surrounding environment information storage unit further stores, for each food product, a best-before time of the food product corresponding to a predetermined food surrounding environment, and the environment control unit is further configured to control the eating-drinking environment based on the best-before time of a certain food product.

7. The eating-drinking environment control system according to claim 1, further comprising:

a served-food information obtaining unit configured to obtain information about a food product that is served in the eating-drinking environment, the environment control unit is further configured to control the eating-drinking environment based on the information about the food product obtained by the served-food information obtaining unit.

8. The eating-drinking environment control system according to claim 7, wherein the served-food information obtaining unit includes an image data obtaining unit configured to obtain an image of a food product served to a user having a meal.

9. The eating-drinking environment control system according to claim 7, wherein the served-food information obtaining unit includes a food accepting unit configured to accept input of information indicating a certain food product.

10. The eating-drinking environment control system according to claim 1, further comprising:

one of a sequence information obtaining unit configured to obtain information about a sequence in which a plurality of food products are to be served, and a sequence information storage unit that stores in advance information about a sequence in which a plurality of food products are to be served, the environment control unit being further configured to control the eating-drinking environment based on the sequence in which the food products are to be served and the food surrounding environment information.

11. The eating-drinking environment control system according to claim 1, wherein the environment control unit further includes a setting change unit configured to accept a change in a setting usable to control the eating-drinking environment.

12. An eating-drinking environment information providing system comprising:

a food surrounding environment information storage unit that stores, for each of a plurality of food products, food surrounding environment information including an absolute value of a temperature and a humidity in association with the food product; and a food surrounding environment information providing unit configured to output a food surrounding environment desired value corresponding to the absolute value of the temperature and the humidity based on the food surrounding environment information.

13. The eating-drinking environment information providing system according to claim 12, further comprising:

one of a sequence information obtaining unit configured to obtain information about a sequence in which a plurality of food products are to be served, and a sequence information storage unit that stores in advance information about a sequence in which a plurality of food products are to be served, the food surrounding environment information providing unit being further configured to output the food surrounding environment desired value based on the sequence in which the food products are to be served and the food surrounding environment information.

14. The eating-drinking environment information providing system according to claim 12, wherein the food surrounding environment information storage unit further stores, for each food product, a best-before time of the food product corresponding to a predetermined food surrounding environment, and the food surrounding environment information providing unit is further configured to output the food surrounding environment desired value based on the best-before time of a certain food product.

15. The eating-drinking environment information providing system according to claim 12, further comprising:

a served-food information obtaining unit configured to obtain information about a food product that is served in an eating-drinking environment, the food surrounding environment information providing unit being further configured to output the food surrounding environment desired value further based on the information about the food product obtained by the served-food information obtaining unit.

16. The eating-drinking environment information providing system according to claim 15, wherein the served-food information obtaining unit includes an image data obtaining unit configured to obtain an image of a food product served to a user having a meal.

17. The eating-drinking environment information providing system according to claim 15, wherein the served-food information obtaining unit includes a food accepting unit configured to accept input of information indicating a certain food product.

18. An eating-drinking environment change apparatus including the eating-drinking environment information providing system according to claim 12, the eating-drinking environment change apparatus further comprising:

a desired-value obtaining unit configured to obtain a food surrounding environment desired value output from the food surrounding environment information providing unit of the eating-drinking environment information providing system; and an environment change unit configured to change an eating-drinking environment based on the food surrounding environment desired value.

19. The eating-drinking environment change apparatus according to claim 18, further comprising:

a position detection unit configured to detect at least one of a position of a food product and a position of a user having a meal, the food surrounding environment information providing unit being further configured to output the food surrounding environment desired value corresponding to the at least one of the temperature and the humidity based on the at least one of the position of the food product and the position of the user having a meal.

20. The eating-drinking environment change apparatus according to claim 18, further comprising:

a setting change unit configured to accept a change in a setting usable to control the eating-drinking environment.

* * * * *